United States Patent [19]

Beaumont

[11] Patent Number: 4,599,861

[45] Date of Patent: Jul. 15, 1986

[54] INTERNAL COMBUSTION HYDRAULIC ENGINE

[76] Inventor: Richard W. Beaumont, 1315 Hickory Ct., Sidney, Ohio 45365

[21] Appl. No.: 733,074

[22] Filed: May 13, 1985

[51] Int. Cl.[4] ..... F02B 71/04

[52] U.S. Cl. ..... 60/595; 417/323; 417/380; 123/46 SC

[58] Field of Search ..... 60/413, 595; 417/323, 417/364, 380; 123/46 SC

[56] References Cited

U.S. PATENT DOCUMENTS 3,044,452 7/1962 McCrory et al. ..... 123/46 SC 4,308,720 1/1982 Brandstadter ..... 60/595

4,326,380 4/1982 Rittmaster et al. ..... 60/595

*Primary Examiner*—Stephen F. Husar

*Attorney, Agent, or Firm*—Prutzman, Kalb, Chilton & Alix

[57] ABSTRACT

An internal combustion hydraulic engine is powered by compression and ignition of pressurized fuel to pressurize hydraulic fluid. The timing and operation of the engine is controlled by a hydraulically driven distributor valve. A pair of starting valves are employed to hydraulically actuate the distributor valve for starting the operation of the engine. An intensifier pump powered by the engine and coordinated with the operation of the engine is employed to pressurize the fuel which is combusted for powering the engine.

20 Claims, 6 Drawing Figures

INTERNAL COMBUSTION HYDRAULIC ENGINE

BACKGROUND AND BRIEF SUMMARY OF THE INVENTION

This invention relates to an engine for producing a supply of hydraulic fluid under a high pressure for driving a hydraulic motor or like hydraulic driven device. More particularly, this invention relates to an internal combustion engine which drives a piston for pressurizing hydraulic fluid.

An aim of the present invention is to provide a new and improved hydraulic engine of efficient construction having a compression ignition power source for pressurizing hydraulic fluid thereby providing an energy source for various hydraulically actuated devices. The hydraulic engine has a linear configuration and employs a free floating composite piston member which reciprocates to pressurize hydraulic fluid. The pressurized fuel employed for driving the piston is pressurized by means of an intensifier pump which is driven by the piston and coordinated with the movement of the reciprocating piston. A hydraulically actuated starting means is employed to start the operation of the engine. The timing and operation of the engine is governed by a hydraulically actuable distributor valve.

Briefly stated, the invention in a preferred form is an internal combustion hydraulic engine having a cylinder which receives pressurized fuel for combustion at one end and receives hydraulic fluid for pressurization at a second end. The cylinder interiorly forms three concentric axial bores having from the one end progressive constant reduced diameters. A piston comprising three interconnected pistons is reciprocatable in the cylinder bores to form a combustion chamber, a scavenger pressure chamber communicatable with the combustion chamber, a piston return chamber and a work chamber. A low pressure conduit selectively connects the return chamber to a reservoir tank which provides a source of hydraulic fluid under a low pressure. A high pressure conduit selectively connects the return chamber to an accumulator tank which provides a source of hydraulic fluid under a high pressure. A distributor valve is interposed in the low pressure conduit and the high pressure conduit and is selectively positionable at a first position to allow fluid communication for releasing pressure from the return chamber. The distributor valve is selectively positionable at a second position to allow fluid communication for pressurizing the return chamber to force the piston toward the first end of the cylinder to pressurize the combustion chamber. A pair of starting valves in fluid communication with the distributor valve are employed to selectively move the distributor valve to the first and second positions for starting the engine. In a preferred embodiment, the distributor valve is a spool valve which is positionable in response to hydraulic pressure, and the starting valves are axially depressable spring biased spool valves. An intensifier pump is employed to pressurize fuel for delivery to an injector nozzle for injection into the combustion chamber. The intensifer pump is hydraulically driven by the reciprocation of the piston and comprises a spring biased plunger which is reciprocatable in a pump chamber in coordination with the reciprocating piston.

An object of the invention is to provide a new and improved internal combustion hydraulic engine.

Another object of the invention is to provide new and improved means for starting the operation of a linear configured, compression/ignition powered hydraulic engine.

A further object of the invention is to provide a new and improved hydraulic engine of efficient construction wherein pressurized fuel employed to power the engine is pressurized by means of hydraulic power generated by the engine.

Other objects and advantages of the invention will become apparent from the drawing and the specification.

DETAILED DESCRIPTION OF THE PREFERRED EMBODIMENT

Figure 1:
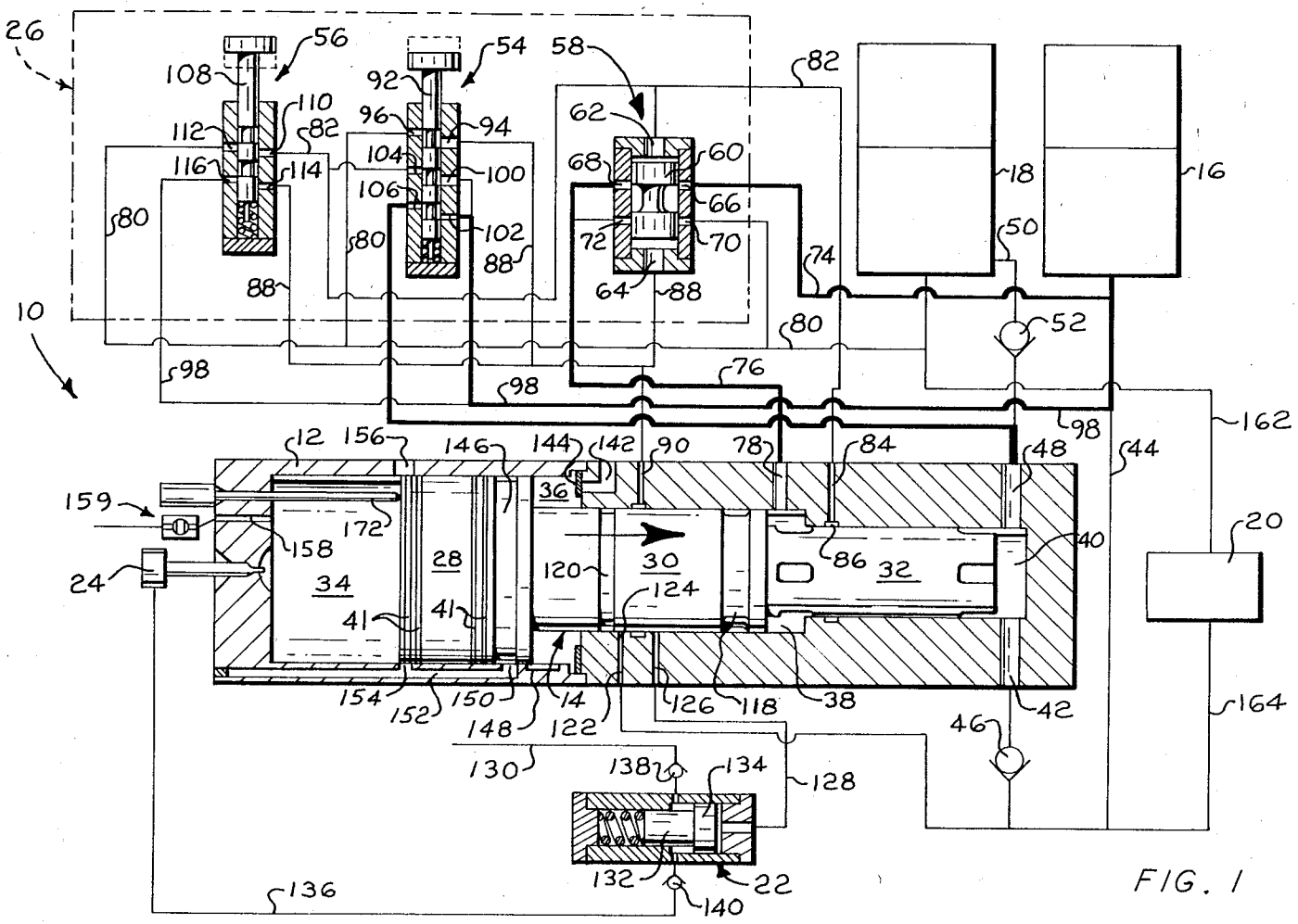
FIG. 1 is an axial sectional view, partly in section and partly in schematic, of an internal combustion hydraulic engine in accordance with the present invention, said engine being illustrated in a compression stroke preparation operational phase.

With reference to the drawing wherein like numerals represent like parts throughout the several FIGURES, an internal combustion hydraulic engine in accordance with the present invention is generally designated by the numeral 10. Hydraulic engine 10 is adapted for pressurizing hydraulic fluid for use in driving a hydraulic power consuming system such as a hydraulic motor, turbine or piston actuator or for performing other useful work functions. The hydraulic engine 10 generally comprises a stepped bore work cylinder 12 having a free reciprocating composite piston 14. The piston 14 is driven by combustion of pressurized fuel within the cylinder to pressurize low pressure hydraulic fluid received from a reservoir tank 16. The pressurized hydraulic fluid is transferred to an accumulator tank 18 which in turn supplies pressurized hydraulic fluid for operating a hydraulic motor designated generally by the numeral 20. The accumulator tank 18 also supplies pressurized fluid for operating the engine. Piston 14 also drives an intensifier pump 22 which receives fuel at a low supply pressure and pressurizes the fuel for delivery to an injector nozzle 24 for injection into the cylinder. A start/regulator unit designated generally by the numeral 26 is employed to start the operation of the engine and to continuously regulate the timing of the engine.

Composite piston 14 has a progressive stepped configuration defined by a driver piston 28, an intermediate piston 30 and a work piston 32 of decreasing respective diameters. The foregoing pistons interconnect to form a composite piston member which freely reciprocates in cylinder 12. Cylinder 12 interiorly forms three stepped concentric bores whereby piston 14 and cylinder 12 cooperate to form a generally cylindrical combustion chamber 34, a generally annular compression chamber 36, a generally annular return chamber 38 and a generally cylindrical work chamber 40. Two pairs of piston sealing rings 41 are preferably circumferentially mounted on a driver piston 28 for sealing with the cylinder to prevent fluid leaking from combustion chamber 34 and compression chamber 36. Additional suitable sealing between the composite piston and the cylinder is achieved through dimensional tolerances and/or conventional sealing elements (not illustrated).

The combustion and compression chambers are formed in the enlarged cylinder bore and are partially defined by opposing active faces of driver piston 28. The return chamber is formed in the intermediate cylinder bore and partially defined by an active face of intermediate piston 30. The work chamber is formed in the reduced cylinder bore and partially defined by an active end of the work piston. The active end of the work piston is preferably slotted to prevent hydraulic locking between the work piston and the cylinder. As the piston reciprocates in a series of compression and power strokes, the volumes of the foregoing chambers continuously vary as will be more fully described below.

Hydraulic fluid under a low pressure is received in work chamber 40 via an inlet passage 42 opening through the cylinder. Reservoir tank 16 contains a supply of hydraulic fluid under a low pressure. A compressed inert gas such as nitrogen forms a head above the level of the hydraulic fluid to provide a supply pressure for the hydraulic fluid. A supply conduit 44 connects the reservoir tank 16 with inlet passage 42 for supplying hydraulic fluid to the work chamber. An inlet check valve 46 is interposed in the supply conduit to provide uni-directional fluid flow to the inlet passage. The reciprocating work piston 32 functions to compress the relatively low pressure hydraulic fluid received in the work chamber to pressurize the hydraulic fluid to a relatively high pressure. The pressurized fluid is expelled through an outlet passage 48 opening through the cylinder. An outlet conduit 50 connects outlet passage 48 with accumulator tank 18 for transferring the pressurized fluid to the accumulator tank. An outlet check valve 52 is interposed in the outlet conduit to provide uni-directional flow of pressurized fluid to the accumulator tank. Accumulator tank 18 functions to accumulate and store the pressurized hydraulic fluid. An inert gas such as nitrogen at a relatively high pressure forms a head above the level of the high pressure hydraulic fluid in accumulator tank 18.

Start/regulator unit 26 which is located apart from the cylinder body comprises a first starting valve 54, a second starting valve 56 and distributor valve 58. The starting valves are employed to start the engine. The distributor valve 58 controls the operation of the engine and regulates the timing sequence as will be described below. Distributor valve 58 includes a free floating spool valve 60 which is axially positionable in response to hydraulic pressure exerted at opposing ends of the valve via pilot ports 62 and 64. Spool valve 60 forms an annulus which provides selective fluid communication between opposing ports 66 and 68 or opposing ports 70 and 72 which are axially spaced from the former port pair. A low pressure conduit 74 leads from supply conduit 44 to port 66 to provide a low pressure hydraulic fluid source. Opposing port 68 opens into a piston return conduit 76 which communicates with the return chamber 38 via a piston return passage 78 formed in the cylinder. A high pressure conduit 80 leads from accumulator tank 18 to convey high pressure hydraulic fluid to distributor port 70. Opposing port 72 connects with piston return conduit 76. A pilot conduit 82 connects port 62 with a pilot passage 84 opening through the cylinder. Pilot passage 84 interiorly terminates at a pilot port 86 which is opened and closed in accordance with the axial position of work piston 32. Port 64 communicates with an actuating conduit 88 which leads to an intermediate passage 90 formed in the cylinder.

First starting valve 54 comprises a spring biased spool valve 92 which is selectively axially depressable from an unactuated position to an actuated position to provide fluid communication between three axially spaced pairs of opposing ports via three axially spaced annuli formed in the valve. In the unactuated position, fluid communication between opposing port pairs is prevented by axially spaced land sections of the spool valve 92. Port 94 communicates with actuating conduit 88. Opposing port 96 communicates with high pressure conduit 80. A second low pressure conduit 98 leads from supply conduit 44 to provide a low pressure hydraulic fluid source at axially spaced ports 100 and 102 of the first starting valve. Port 104 which selectively communicates with opposing port 100 communicates with pilot conduit 82. Port 106 which selectively communicates with opposing port 102 communicates with outlet conduit 50.

Second starting valve 56 comprises a spring biased axially depressable spool valve 108 forming a pair of axially spaced annuli which provide selective communication with one of two axially spaced opposing pairs of ports. Port 110 communicates with pilot conduit 82. Opposing port 112 communicates with high pressure conduit 80. Port 114 communicates with actuating conduit 88. Opposing port 116 communicates with second low pressure conduit 98.

Intermediate piston 30 forms an intensifier annulus 118 and a vent annulus 120 which is axially spaced from the intensifier annulus. Intermediate piston 30 thus forms three axially spaced land sections which interact with the intermediate bore of cylinder 12 as will be further described below. An intermediate vent passage 122 opening through the cylinder connects with supply conduit 44 and forms a vent port 124 which is selectively opened and closed by the intermediate piston 30. A second passage 126 opens through the cylinder and communicates with a pump drive conduit 128 leading to the intensifier pump 22.

A fuel supply conduit 130 communicates with intensifier pump 22 for supplying fuel having a normal storage tank pressure on the order of 1–3 psi. Intensifier pump 22 includes a pump chamber which receives the low pressure fuel supply. A spring biased plunger 132 reciprocates within the chamber to pressurize the fuel. The plunger 132 connects with an enlarged piston head 134 which is driven by hydraulic pressure received via pump drive conduit 128. The plunger reciprocates in response to a fluctuating pressure exerted against the piston head and the opposing bias of a spring to sequentially pressurize fuel to a pressure on the order 10,000 psi. A fuel conduit 136 leads from the pump chamber to nozzle 24 for conveying the pressurized fuel for injection into the combustion chamber 34. An inlet check valv 138 is interposed in fuel supply conduit 130 to provide uni-directional fuel flow to the intensifier pump and an outlet check valve 140 is interposed in fuel conduit 136 to provide unidirectional pressurized fuel flow to the injector nozzle.

The compression chamber 36 selectively communicates with the ambient environment via an inlet passage 142 formed in the cylinder. A plate valve 144 selectively opens and closes the inlet passage. A scavenger annulus 146 is formed in the driver piston 28 for providing selective communication between an annulus 148 formed in cylinder 12 and a port 150 which is formed at the terminus of an axially extending scavenger passage 152. In accordance with the axial position of the driver piston, scavenger passage also selectively opens at a second port 154 into combustion chamber 34. Driver piston 28 also functions to open and close an exhaust port 156 for the combustion chamber in accordance with the axial position of driver piston 28.

A compressed air passage 158 is formed in the end of the cylinder for injecting compressed air into the combustion chamber as will be more fully described below. An air supply valve 159 controls the injection of compressed air into the combustion chamber. Alternately, a bore 170 may be formed in the end of cylinder 12 as shown in dashed lines in FIG. 1. The outer end of the bore is threaded for receiving a plug (not illustrated) which is normally threaded into place for sealing the bore. Before starting the engine, the plug may be removed and a rod 174 inserted through the bore 170 and into the combustion chamber 34 for engagement against driver piston 28 to force the piston to an axial position for starting the engine as will be described below. A handle 176 at one end of the rod engages the cylinder to provide a stop defining the axial start position of piston 14.

The operation of the illustrated embodiment of the internal combustion hydraulic engine of the present invention is illustrated by the operational sequence illustrated in the FIGURES. The principal fluid communication relationships which govern a given illustrated operational phase have been illustrated with heavy lines in the drawing to facilitate an understanding of the operation of the engine. With specific reference to FIG. 1, an engine operational phase which prepares the engine for starting the compression stroke is illustrated. The piston 14 is axially displaced in the direction of the arrow to the depicted starting position by depressing the first starting valve 54 as schematically illustrated. Upon depressing the spool valve g2 to the actuating position illustrated in FIG. 1, fluid communication between ports 102 and 106 vents outlet conduit 50 to the second low pressure conduit 98 to release the pressure of the hydraulic fluid in work chamber 40. In addition, communication between ports g4 and g6 results in fluid communication between high pressure conduit 80 and actuator conduit 88 whereby pressurized fluid enters distributor port 64 to drive the spool valve 60 to close fluid communication between ports 70 and 72 and to provide fluid communication between ports 66 and 68. The fluid communication between ports 66 and 68 causes the return chamber 38 to be vented via return passage 78, return conduit 76 and low pressure conduit 74 to release pressurized fluid from the return chamber 38. The release of the pressure in the return chamber 38 as well as the pressure release in the work chamber 40 allows the piston to be displaced in the direction of the arrow toward the end of the work chamber as depicted in FIG. 1.

Figure 2:
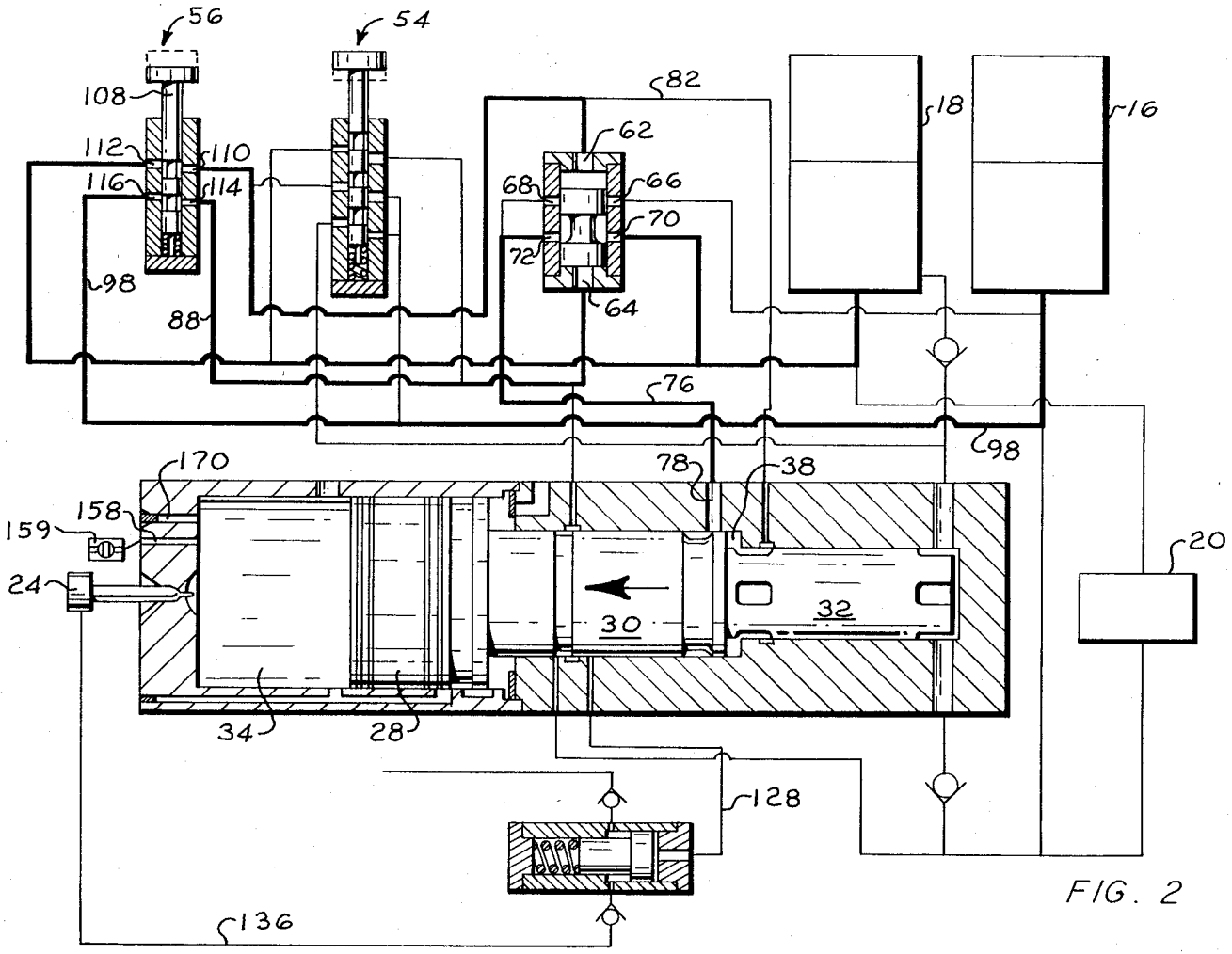
FIG. 2 is an axial sectional view, partly in section and partly in schematic, illustrating the hydraulic engine of FIG. 1 in a compression stroke starting operational phase.

At approximately the same time that the starting valve 54 is actuated, compressed air at approximately 100 psi is admitted into combustion chamber 34 via valve 159 and passage 158 to drive the piston to the compression stroke starting position illustrated in FIG. 2. The motion of the piston is terminated by fluid resistance in return chamber 38. The air supply valve 159 is closed and starting valve 54 is returned to the unactuated position. As an alternative to shifting the piston by compressed air, a plug may be removed from bore 170 and rod 172 manually inserted into the bore (as illustrated in FIG. 1). The end of the rod engages driver piston 28. The starting valve 54 is actuated as previously described to vent chambers 38 and 40. The rod is axially moved to force the piston to the position of FIG. 2. A handle at the end of the rod may function as a stop to define the foregoing axial position upon engagement against the cylinder. The rod is then removed from the cylinder and the plug rethreaded into the bore.

With reference to the compression stroke starting phase illustrated in FIG. 2, first starting valve 54 is released to an unactuated state and second starting valve 56 is depressed to the depicted actuated position. In the actuated position, ports 114 and 116 of the second starting valve communicate via an annulus in spool valve 108 to provide low pressure fluid communication between second low pressure conduit 98 and actuating conduit 88 to release pressure at distributor port 64. In addition, high pressure conduit 80 communicates with pilot conduit 82 via ports 110 and 112 of the second starting valve to provide a high pressure fluid source at distributor port 62 for driving the distributor spool valve 60 to close communication between port 66 and 68 and provide fluid communication between ports 70 and 72. High pressure conduit 80 communicates via ports 70 and 72 with return conduit 76 to initiate pressurization of return chamber 38 via return passage 78. At initial stages of pressurization of chamber 38, high pressure fuel leaks from passage 78 past the end of intermediate piston 30 to return chamber 38. After sufficient pressurization and expansion of chamber 38 pressurized fluid communicates directly from passage 78 to chamber 38. The pressurization of the return chamber causes the piston to commence axial movement in the direction of the arrow of FIG. 2 toward the combustion end of the cylinder to thereby commence the compression stroke.

Figure 3:
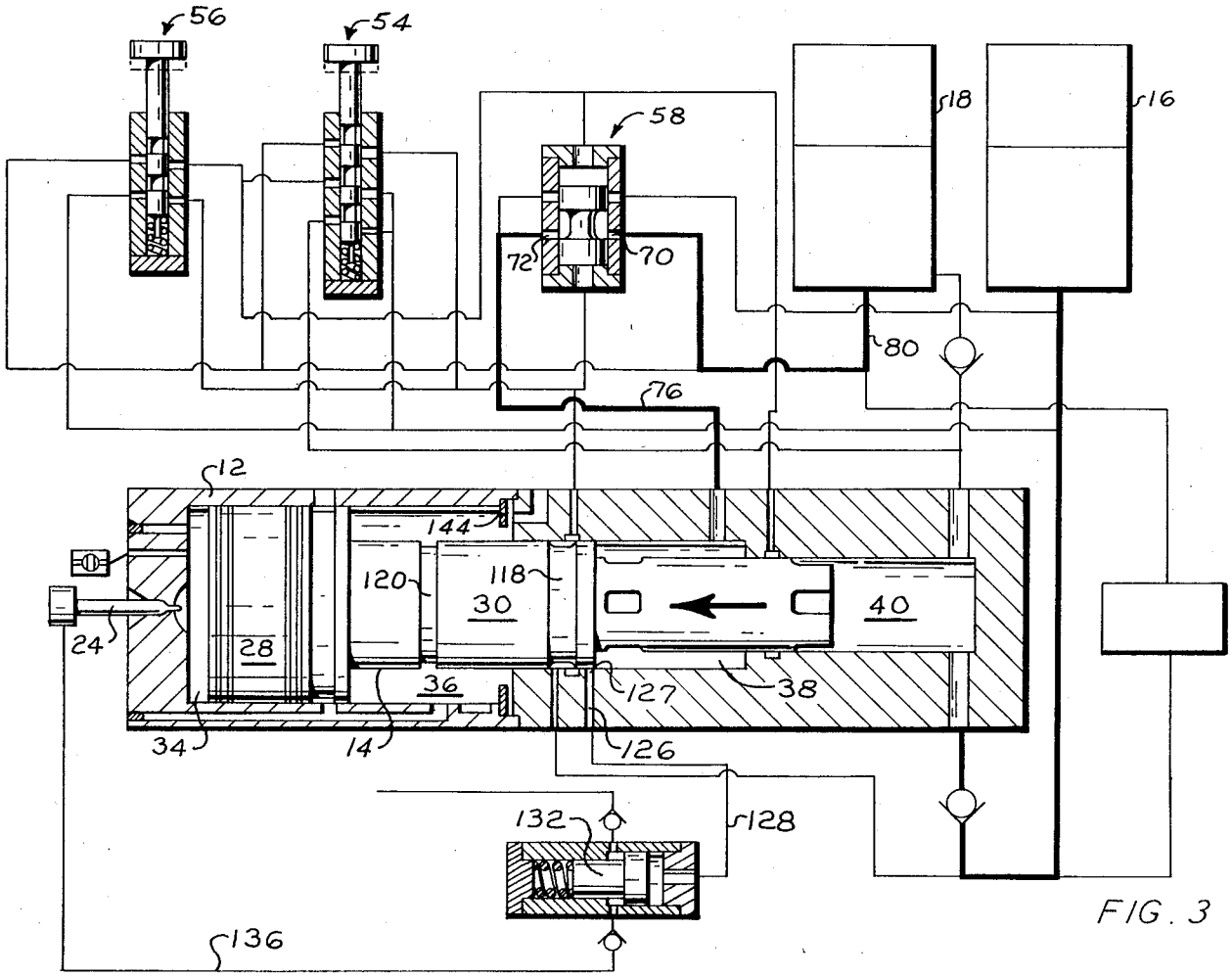
FIG. 3 is an axial sectional view, partly in section and partly in schematic, illustrating the hydraulic engine of FIG. 1 in a compression/injection operational phase.

With reference to FIG. 3, a compression/injection phase is illustrated near the termination of the compression stroke wherein the piston 14 has been displaced to thereby reduce the volume of the combustion chamber 34 and to expand the volume of the work chamber 40. The volumes of the compression chamber 36 and return chamber 38 have also been substantially expanded relative to the corresponding volumes for the piston position of FIG. 2. It will be appreciated that the volumes of the combustion chamber 34 and the work chamber 40 vary inversely in accordance with the axial position of piston 14 and the volumes of compression chamber 36, return chamber 38, and work chamber 40 correspondingly proportionally expand and contract in accordance with the axial position of piston 14. High pressure fluid acting in return chamber 38 against the end of intermediate piston 30 continuously forces the piston toward the ignition end of the cylinder. The air for the combustion of fuel injected through nozzle 24 is compressed by driver piston 28.

In the compression/injection phase of FIG. 3, both the first and second starting valves have been released and high pressure conduit 80 continues to communicate with the return conduit 76 to pressurize the expanding return chamber 38. As the piston moves toward the combustion end of the cylinder, intermediate piston 30 eventually uncovers port 127 of passage 126 so that high pressure fluid communicates via pump drive conduit 128 to drive plunger 132 for pressurizing the fuel received by the intensifier pump. The pressurized fuel is forced from the intensifier pump via the fuel conduit 136 for injection through injector nozzle 24 into the combustion chamber 34.

During the compression stroke, scavenging air is drawn into the compression chamber 36 past the plate check valve 144 due to the expanding volume of the compression chamber. At the same time, low pressure hydraulic fluid is also drawn into the work chamber 40 from the reservoir tank 16 due to the expanding volume of the work chamber.

Figure 4:
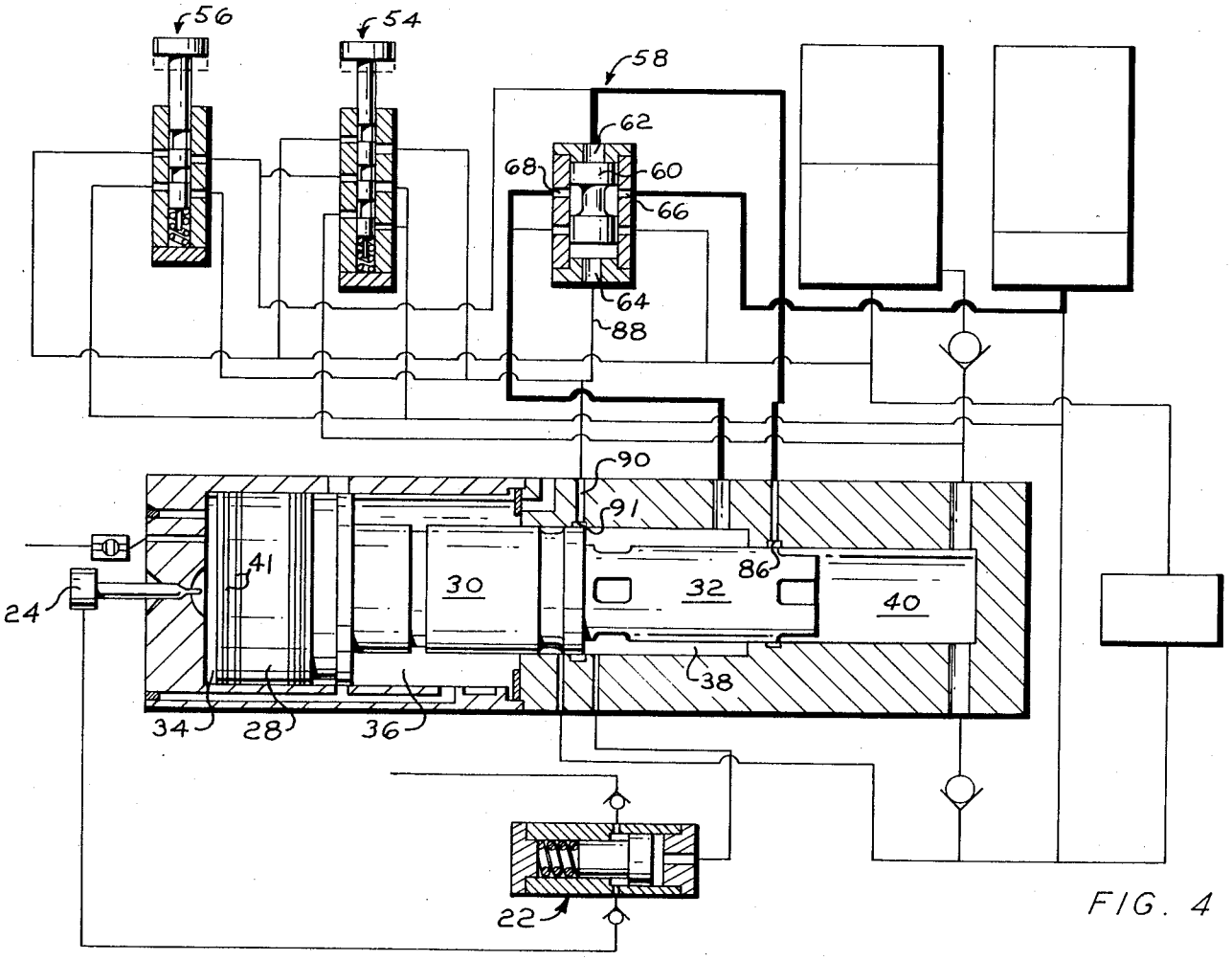
FIG. 4 is an axial sectional view, partly in section and partly in schematic, illustrating the hydraulic engine of FIG. 1 in the combustion operational phase.

With reference to FIG. 4, the hydraulic engine is illustrated in the combustion phase of the engine operation wherein the maximum compression of the combustion chamber is attained. The axial displacement of the piston toward the combustion end of the cylinder, i.e., the compression stroke, is terminated due to a shift in the distributor valve 58 and the pressure increase resulting from the combustion of the fuel in the combustion chamber. The end of work piston 32 uncovers pilot port 86 to allow low pressure fluid communication between the relatively low pressure fluid in expanded work chamber 40 and port 62 of the distributor valve. The end of intermediate piston 30 also uncovers port 91 to provide high pressure fluid communication from the return chamber 38 via passage 90 and actuating conduit 88 to port 64 of the distributor valve to thereby drive the spool valve 60 to provide fluid communication between ports 66 and 68. The foregoing communication between ports 66 and 68 connects return conduit 76 with the first low pressure conduit 74 thus releasing the pressure in the return chamber 38 to the low pressure reservoir tank 16.

Figure 5:
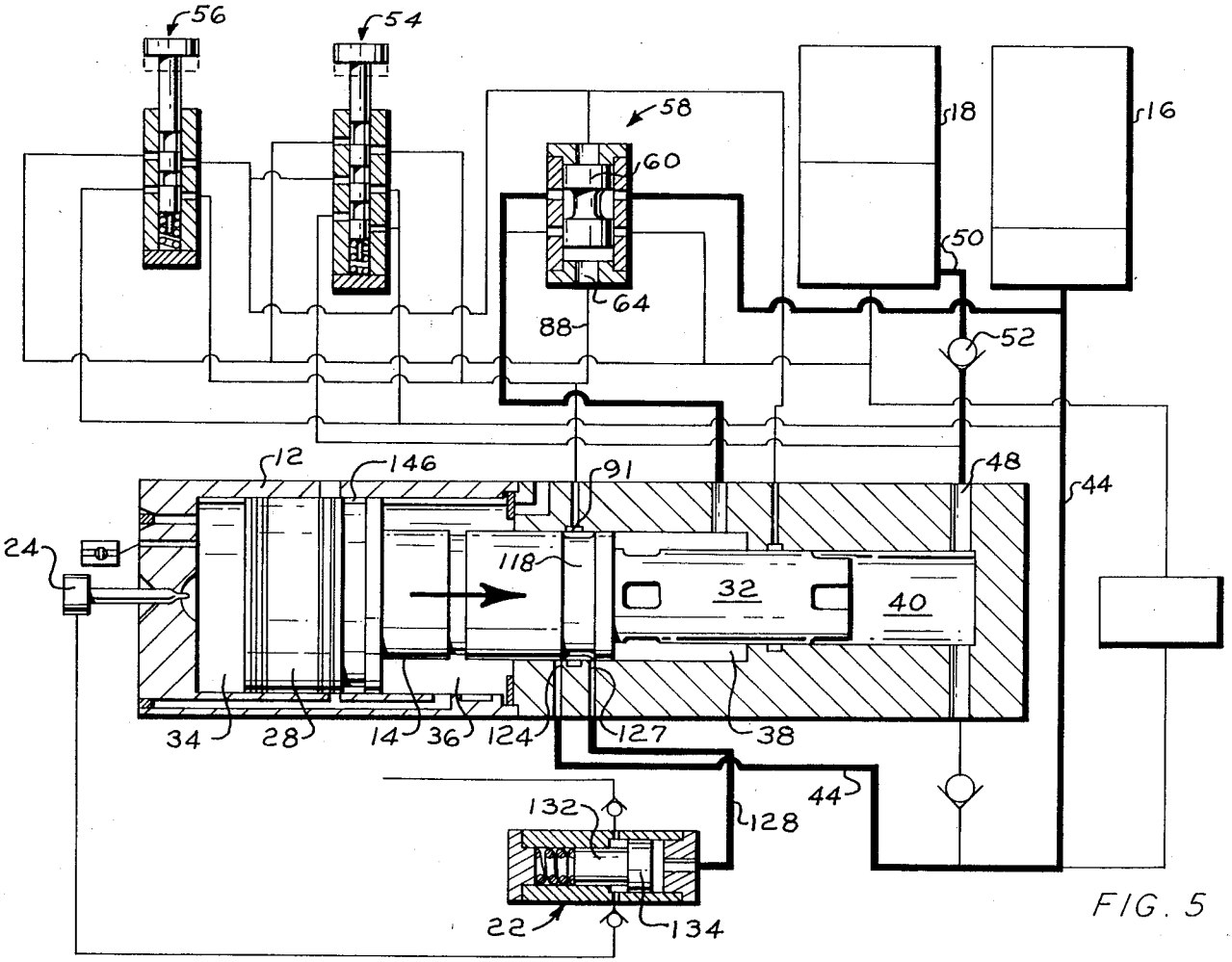
FIG. 5 is an axial sectional view, partly in section and partly in schematic, illustrating the hydraulic engine of FIG. 1 in an expansion and power operational phase.

With reference to FIG. 5 wherein the power stroke/expansion phase of the engine operation is illustrated, the piston 14 is displaced in the direction of the arrow by the expanding combustion gases in combustion chamber 34. Hydraulic fluid in work chamber 40 is consequently compressed with the pressurized fluid being expelled into the accumulator tank 18 through outlet conduit 50 and outlet check valve 52. The intensifier annulus 118 of the intermediate piston interconnects ports 124 and 127 to provide fluid communication between supply conduit 44 and pump drive conduit 128 thereby releasing the pressure against piston head 134 so that plunger 132 is returned to a retracted unactuated position. Intensifier annulus 118 so aligns with port 91 to provide a low pressure fluid communication path between the supply conduit 44 and port 64 of the distributor valve 58. The continuous movement of the piston in the direction of the arrow due to the expanding combustion of gases results in a corresponding reduction of the volumes of compression chamber 36 and return chamber 38. The air in compression chamber 36 is correspondingly compressed due to the contracting volume of the chamber.

Figure 6:
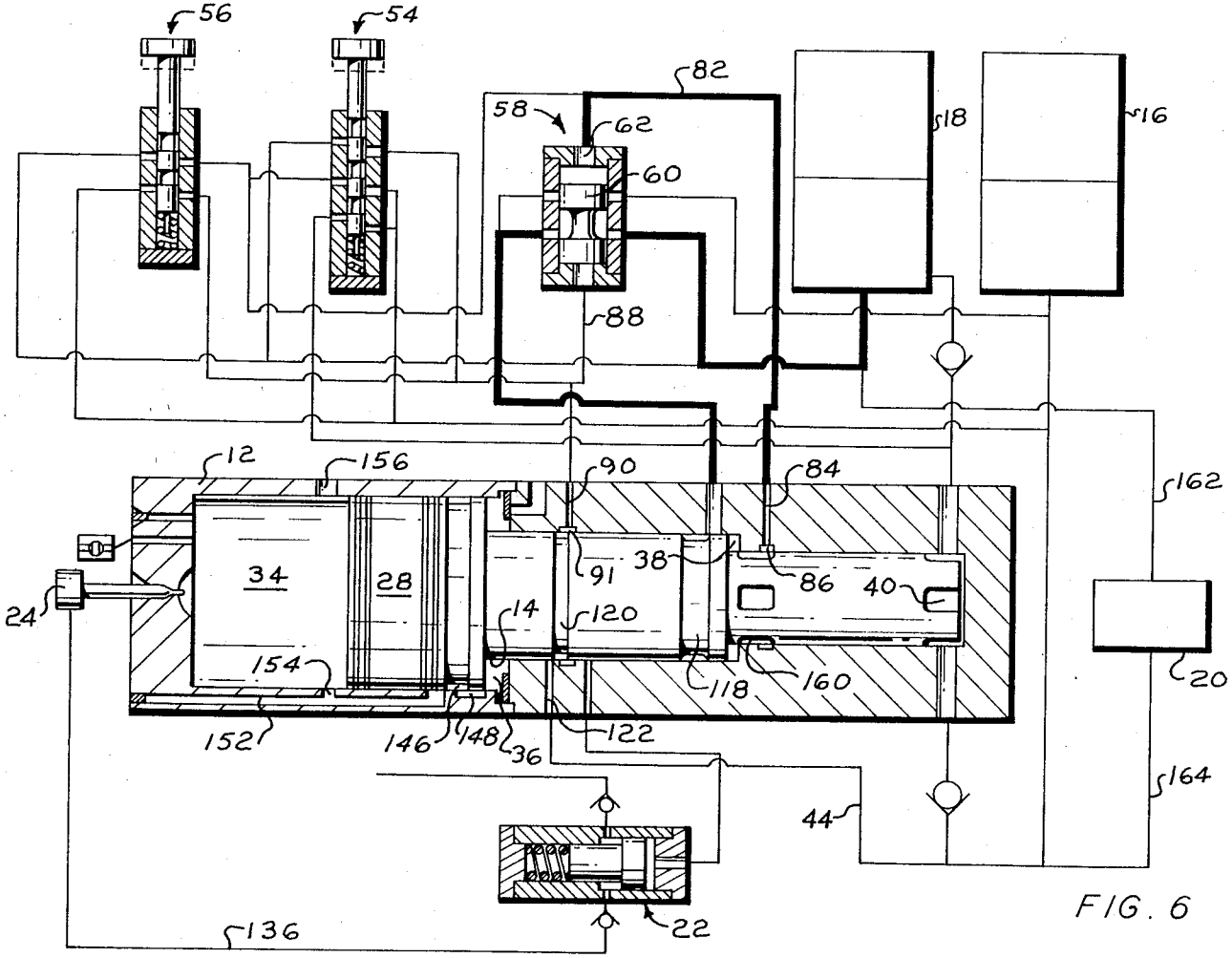
FIG. 6 is an axial sectional view, partly in section and partly in schematic, illustrating the hydraulic engine of FIG. 1 in an exhaust and piston reversal operational phase.

With reference to FIG. 6 wherein an exhaust/piston reversal phase of the engine operation is illustrated, axial movement of piston 14 continues toward the work end of the cylinder until the position of FIG. 6 is attained and the power stroke terminates. The combustion exhaust gases escape through exhaust ports 156 (only one being illustrated). Compressed air in compression chamber 36 communicates via annulus 148 of the cylinder and scavenger annulus 146 of the work piston for passage through port 150, scavenger passage 152 and port 154 into the combustion chamber 34. The expanding scavenging air forces combustion exhaust gases from the combustion chamber through the exhaust ports 156.

The movement of piston 14 is retarded by the compressed fluid which is trapped in the compressed return chamber 38. The compressed fluid ultimately provides a hydraulic cushion that prevents metal to metal contact between the piston and the cylinder. An axial groove 160 formed in the sides of work piston 32 provides fluid communication between the return chamber 38 and distributor port 62 via pilot port 86, pilot passage 84 and pilot conduit 82. The foregoing fluid communication path results in high pressure fluid flowing to port 62 for driving the spool valve 60 of the distributor valve 58 to the position depicted in FIG. 6. Pressure at the opposite end of the spool valve is released due to the communication of actuating conduit 88 with intermediate passage 90, port 91, vent annulus 120, vent passage 122 and supply conduit 44.

It will be appreciated that the engine is now essentially in the same pre-compression stroke operational sequence as that depicted in FIG. 3 so that the operational cycle of the engine may be cyclically repeated. Continuous automatic reciprocation of the piston as previously described may thus automatically continue until the fuel supply is terminated. It should be appreciated that the first starting valve and the second starting valve and the use of the compressed air or positioning rod to drive the driver piston from the combustion chamber are only required to initially start the engine. Once the operational cycle of the engine is commenced, the distributor valve 58 automatically functions to control the operation and timing of the engine. The pressurized hydraulic fluid which is continuously produced by the reciprocating piston and expelled from the outlet passage to the accumulator tank is preferably circulated through a hydraulic conduit 162 for driving a hydraulic motor 20 or other hydraulically operated device. A return conduit 164 may also connect motor 20 with the low pressure supply conduit 44 to provide a continuous hydraulic circuit.

In one embodiment of an internal combustion hydraulic engine as illustrated, the piston is capable of developing approximately 60 horsepower at a reciprocating frequency of 500 cycles per minute. The diameter of the driver piston 28 is 6 inches and the diameter of the work piston 32 is $2\frac{3}{4}$ inches. A 4 inch displacement stroke of the work piston in the work chamber displaces approximately 50 gallons per minute at an average pressure of 2,000 psi. A piston having the foregoing dimensions weighs approximately 65 lbs. In order to minimize the axial vibration of the piston, the cylinder housing preferably weighs at least 65 lbs. In preferred form, the cylinder is mounted to a base plate (not illustrated) having resilient elastomer mountings in order to compensate for the vibration characteristics of the reciprocating engine. It should be noted that the engine may also be mounted in an upright vertical orientation wherein the piston reciprocates along a vertical axis.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. An internal combustion hydraulic engine comprising:

cylinder means to receive pressurized fuel for combustion thereof at one end and to receive hydraulic fluid for pressurization thereof at a second end;

piston means axially reciprocatable in said cylinder means to pressurize hydraulic fluid, said piston means and said cylinder means cooperating to form a combustion chamber, a scavenger pressure chamber communicatable with said combustion chamber, a piston return chamber and a work chamber;

actuator means to move said piston to an axial start position;

return pressurization means to selectively pressurize said return chamber to force said piston means from said start position toward said first end to pressurize said combustion chamber;

fuel supply means to supply pressurized fuel to said combustion chamber to effect combustion thereof;

hydraulic fluid supply means to supply hydraulic fluid to said work chamber;

pressure release means to selectively release pressure from said return chamber and said work chamber; and scavenging means to selectively supply pressurized fluid from said scavenger pressure chamber to said combustion chamber to force fuel combustion exhausts from said combustion chamber whereby combustion of pressurized fuel in said combustion chamber drives said piston means to pressurize hydraulic fluid in said work chamber.

2. The hydraulic engine of claim 1 wherein said cylinder means comprises a cylinder interiorly forming three concentric axial bores having progressive constant reduced diameters from said first end to said second end and said piston means comprises three interconnected pistons respectively reciprocatable in said three bores.

3. The hydraulic engine of claim 1 further comprising:

reservoir means to provide a source of hydraulic fluid under a low pressure;

accumulator means to provide a source of hydraulic fluid under a high pressure;

low pressure conduit means to selectively connect said piston return chamber to said reservoir means for fluid communication therebetween; and high pressure conduit means to selectively connect said piston return chamber to said accumulator means for fluid communication therebetween.

4. The hydraulic engine of claim 3 further comprising a distributor valve means interposed in said low pressure conduit means and said high pressure conduit means and selectively positionable at a first position to allow fluid communication between said reservoir means and said return piston chamber and prevent fluid communication between said accumulator means and said return piston chamber and positionable at a second position to allow fluid communication between said accumulator means and said return chamber and prevent fluid communication between said reservoir means and said return chamber.

5. The hydraulic engine of claim 4 wherein said distributor valve means comprises a spool valve forming an annulus for fluid communication, said spool valve being axially displaceable to said first and second positions in response to fluid pressure exerted at opposing ends of said valve.

6. The hydraulic engine of claim 5 further comprising first starting valve means in fluid communication with said distributor valve means and selectively actuable to force said distributor valve means to said second position.

7. The hydraulic engine of claim 6 further comprising second starting valve means in fluid communication with said distributor valve means and selectively actuable to force said distributor valve means to said second position.

8. The hydraulic engine of claim 6 wherein said first starting valve means comprises a spring biased axially depressable spool valve.

9. The hydraulic engine of claim 7 wherein said second starting valve means comprises a spring biased axially depressable spool valve.

10. The hydraulic engine of claim 1 wherein said cylinder means further comprises a pair of axially spaced passages and said piston means forms an annulus which is axially alignable with said passages to provide fluid communication between said scavenger chamber and said combustion chamber.

11. The hydraulic engine of claim 1 wherein said fuel supply means comprises an intensifier pump means to pressurize fuel, said intensifier pump means being hydraulically driven by the reciprocation of said piston means.

12. The hydraulic engine of claim 11 further comprising a pump conduit means selectively connecting said intensifier pump means with a source of high pressure in said return chamber to drive said intensifier pump means.

13. The hydraulic engine of claim 11 wherein said intensifier pump means further comprises a pump chamber and a spring biased plunger reciprocatable in said pump chamber to pressurize fuel.

14. An internal combustion hydraulic engine comprising:

cylinder means to receive pressurized fuel for combustion thereof at one end and to receive hydraulic fluid for pressurization thereof at a second end;

piston means axially reciprocatable in said cylinder means to pressurize hydraulic fluid, said piston means and said cylinder means cooperating to form a combustion chamber, a piston return chamber and a work chamber;

fuel supply means to supply pressurized fuel to said combustion chamber to effect combustion thereof;

actuator means to move said piston means to an axial start position;

reservoir means to provide a source of hydraulic fluid under a low pressure;

accumulator means to provide a source of hydraulic fluid under a high pressure;

low pressure conduit means to selectively connect said return chamber to said reservoir means for fluid communication therebetween;

high pressure conduit means to selectively connect said return chamber to said accumulator means for fluid communication therebetween; and distributor valve means interposed in said low pressure conduit means and said high pressure conduit means and selectively positionable at a first position to allow fluid communication between said reservoir means and said return chamber to release pressure therefrom and selectively positionable at a second position to allow fluid communication between said accumulator means and said return chamber to force said piston means from said start position toward said first end to pressurize said combustion chamber so that combustion of pressurized fuel in said combustion chamber drives said piston means to pressurize hydraulic fluid in said work chamber.

15. The hydraulic engine of claim 14 wherein said distributor valve means comprises a spool valve forming an annulus for fluid communication, said spool valve being axially displaceable to said first and second positions in response to fluid pressure exerted at opposing ends of said valve.

16. The hydraulic engine of claim 14 further comprising first starting valve means in fluid communication with said distributor valve means and selectively actuable to force said distributor valve means to said second position and a second starting valve means in fluid communication with said distributor valve means and selectively actuable to force said distributor valve means to said first position.

17. An internal combustion hydraulic engine comprising:

cylinder means to receive pressurized fuel for combustion thereof at one end and to receive hydraulic fluid for pressurization thereof at a second end;

piston means axially reciprocatable in said cylinder means to pressurize hydraulic fluid, said piston means and said cylinder means cooperating to form a combustion chamber, a piston return chamber and a work chamber;

actuator means to move said piston means to an axial start position;

return pressurization means to selectively pressurize said return chamber to force said piston means from said start position toward said first end to pressurize said combustion chamber;

fuel supply means to supply pressurized fuel to said combustion chamber for combustion thereof comprising a fuel intensifier pump means to pressurize fuel, said pump means being hydraulically driven by the reciprocation of said piston means;

hydraulic fluid supply means to supply hydraulic fluid to said work chamber; and pressure release means to selectively release pressure from said return chamber and said work chamber so that combustion of pressurized fuel in said combustion chamber drives said piston means to pressurize hydraulic fluid in said work chamber.

18. The hydraulic engine of claim 17 further comprising a pump conduit means selectively connecting said intensifier pump means with a source of high pressure in said return chamber to drive said pump means.

19. The hydraulic engine of claim 18 wherein said intensifier pump means further comprises a pump chamber and a spring biased plunger reciprocatable in said pump chamber to pressurize fuel.

20. The hydraulic engine of claim 18 wherein said pump conduit means further selectively communicates with a source of low pressure.

* * * * *